United States Patent [19]

Galvin

[11] Patent Number: 4,752,052

[45] Date of Patent: Jun. 21, 1988

[54] PROJECTILE

[75] Inventor: Mark W. Galvin, Simi Valley, Calif.

[73] Assignee: The Marquardt Company, Van Nuys, Calif.

[21] Appl. No.: 942,724

[22] Filed: Dec. 17, 1986

[51] Int. Cl.[4] ..... F42B 15/053

[52] U.S. Cl. ..... 244/3.29; 244/3.27

[58] Field of Search ..... 244/3.27, 3.28, 3.29, 244/3.3, 3.26

[56] References Cited

U.S. PATENT DOCUMENTS

| | | | |
|---|---|---|---|
| 25,080 | 8/1859 | Goodspeed | 244/3.28 |
| 3,374,969 | 3/1968 | Rhodes | 244/3.27 |
| 3,724,782 | 4/1973 | Gauzza et al. | 244/3.27 |

FOREIGN PATENT DOCUMENTS

| | | | |
|---|---|---|---|
| 3408585 | 9/1985 | Fed. Rep. of Germany | 244/3.28 |
| 1605347 | 10/1974 | France | 244/3.29 |
| 8602154 | 4/1986 | World Int. Prop. O. | 244/3.27 |
| 745252 | 2/1956 | United Kingdom | 244/3.29 |
| 1597098 | 9/1981 | United Kingdom | 244/3.28 |

*Primary Examiner*—Deborah L. Kyle
*Assistant Examiner*—Michael J. Carone
*Attorney, Agent, or Firm*—John J. Posta, Jr.

[57] ABSTRACT

The projectile includes a preferably cylindrical body, with an outer preferably generally cylindrical shell disposed over a portion thereof, having a fixed end secured to the body and a rotatable opposite end. The shell bears a number of spaced fins simultaneously moveable between a closed low-profile position and a deployed flight-stabilizing position by rotating the rotatable shell end. Each fin has a pair of elongated plates hinged together at one end, and the fin plates are also hinged to the shell at opposite ends thereof. The plates are aligned in a direction diagonal to the longitudinal axis of the body, while the hinges are parallel to that axis. The projectile includes an impeller connected to the rotatable end of the shell for rotation thereof around the body's longitudinal axis. In the deployed position the fins are preferably dome-shaped with central air passageways, with the main plane of the plates parallel to the body longitudinal axis for minimum air drag and with the fins at about the same transverse position. The impeller may include a return spring, a releasable lock and/or a cowling keyed to a rotor and to the rotatable shell end.

18 Claims, 2 Drawing Sheets

PROJECTILE

BACKGROUND OF THE INVENTION

1. FIELD OF THE INVENTION .

The present invention generally relates to projectiles and, more particularly, to a fin-bearing stabilized type of projectile.

2. PRIOR ART

Various types of fin-stabilized projectiles, such as missiles, bombs, marking devices, flares and the like have been provided in the past. Certain of such projectiles include fins which move from a collapsed or closed position for storage to an open or deployed stabilizing position. One such device is shown in U.S. Pat. No. 3,374,969. In that patent a projectile which can be fired from a small bore weapon is disclosed. Interlocked spring metallic vanes are held in a closed position by a gun bore and they automatically spring out to form a shrouded fin assembly, once the projectile is launched from the gun bore. The fins assume a spiral or helical configuration within the shroud. Such a device is useful for certain special small gun-fired projectiles but is complicated and impractical for larger projectiles.

A spin-cone stabilized projectile is disclosed in U.S. Pat. No. 3,081,703. Interleaved trapezoidal vanes interlocked at their edges are connected to a projectile and when the projectile is fired, they form a frusto-conical discharge nozzle fanning out behind the rear of the main projectile body and having substantial air drag. U.S. Pat. No. 412,670 is similar in that a plurality of collapsible vanes hinged at their front ends to a shell body spring outwardly when deployed to form a frusto-conical rear stabilizing array with considerable air drag.

U.S. Pat. No. 4,162,053 discloses a braking device for a rotating body such as a load-bearing vehicle ejected from a projectile. The device includes curved, angled vanes or blades which extend to retard both linear and relative movement, thus providing considerable air drag.

There remains a need for an improved type of simple, inexpensive projectile having fins which can be easily closed for storage and as easily deployed for use, which vanes flight-stabilize the projectile while presenting a minimum amount of projectile-slowing air drag.

SUMMARY OF THE INVENTION

The improved finned projectile of the present invention satisfies all the foregoing needs. The projectile is substantially as set forth in the Abstract. Thus, the projectile includes a preferably generally cylindrical projectile body with a preferably generally cylindrical finned shell disposed around the outer periphery of a portion of the projectile body. The shell has one of its ends fixed to the projectile body while the opposite end of the shell is freely rotatable around the longitudinal axis of the projectile body and is secured to an impeller device which effects such rotation.

A number of fins are secured to and form part of the shell. The fins, when in the storage or closed position, lie flat against the shell or projectile body to minimize storage space. Each fin comprises a pair of elongated, preferably curved plates hinged to each other end to end, opposite ends thereof being hinged to the shell. The hinges extend parallel to the longitudinal axis of the shell. The plate pairs are disposed diagonally in spiral fashion around the shell. When the rotatable end of the shell is rotated in a direction which deploys the fins, each plate pair extends radially from the projectile to form a preferably dome-shaped fin, with the main plate of the plates parallel to the longitudinal axis of the projectile and the plates defining a front to rear central passageway therethrough. Thus, the fins have minimum air drag but maximum flight-stabilizing ability.

The impeller device can include a coil spring biasing the rotatable shell end into either the closed or deployed fin position, a releasable lock to hold that shell end in a desired position, and/or a reversible rotor or the like in the projectile body connected to a cowling or the like, in turn keyed to the rotatable shell end. The rotor can be powdered electrically or by other power means provided in the projectile.

Further features of the invention are set forth in the following detailed description and accompanying drawings.

DRAWINGS

DETAILED DESCRIPTION

FIGS. 1–3

Figure 1:
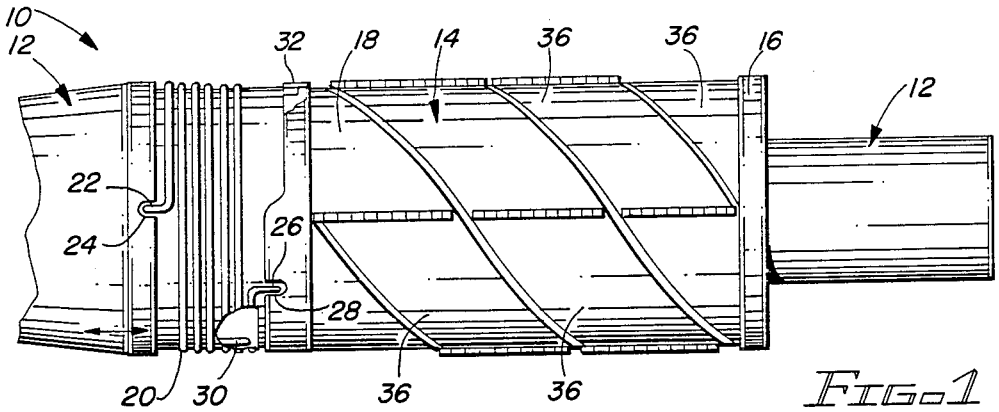
FIG. 1 is a schematic side elevation, partly broken away, illustrating a first preferred embodiment of the improved finned projectile of the present invention, shown in the closed fin storage position.
Figure 2:
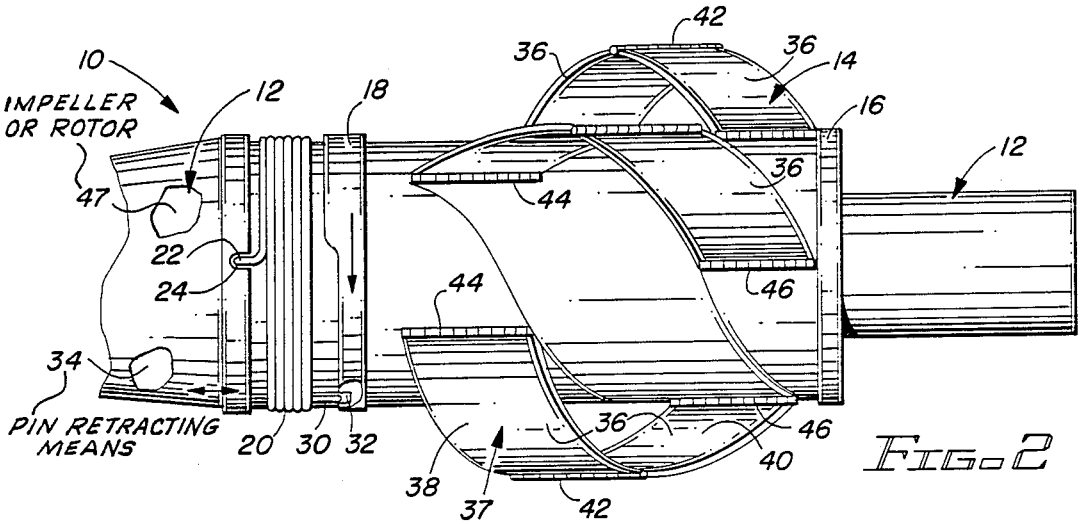
FIG. 2 is a schematic perspective view, partly broken away, of the projectile of FIG. 1, shown in the deployed fin operative position.
Figure 3:
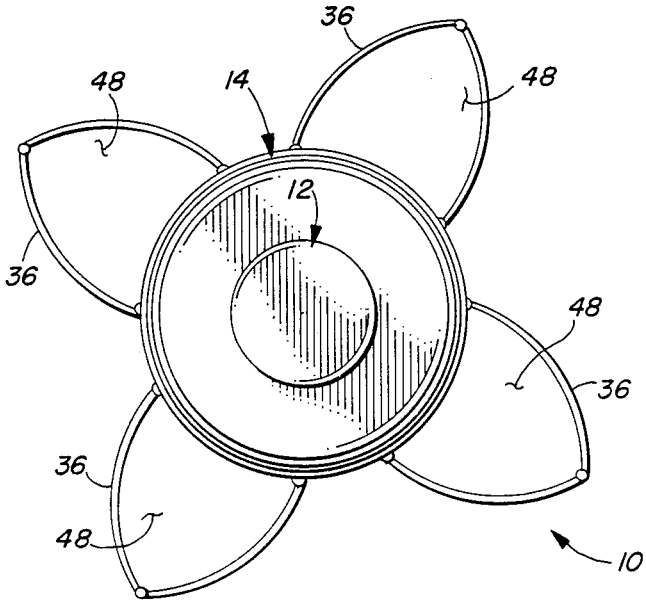
FIG. 3 is a schematic rear elevation of the projectile of FIG. 2.

Now referring more particularly to FIGS. 1–3 of the accompanying drawings, a first preferred embodiment of the improved projectile of the present invention is schematically depicted therein. Thus, projectile 10 is shown which comprises a preferably generally cylindrical body 12 having a preferably generally cylindrical thin shell 14 disposed around a portion thereof. Shell 14 has one end 16 (rear end) fixedly secured to projectile body 12 while the opposite end 18 (front end) of shell 18 is free to rotate around the longitudinal axis of body 12 and shell 14.

A coil spring 20 is disposed around body 12 and connected thereto by tab 22 in slot 24 of body 12. Spring 20 is connected to end 18 of shell 14 by tab 26 in slot 28 of shell 14. Spring 20 biases shell end 18 into the closed fin position of FIG. 1. It will be understood that, if desired, spring 20 could, instead, be arranged to bias shell end 18 into the fin deployed position by FIG. 2.

A spring biased lock pin 30 passes through body 12 and rides against the opposing face of end 18 until it drops into slot 32 when end 18 is fully rotated to the fin deployed position shown in FIG. 2, so as to releasably lock end 18 in that position. Pin 30 can be withdrawn from slot 32 by retracting means 34 in body 12 which may be withdrawn, for example, a servomechanism, such as a solenoid or the like.

Shell 14 is provided with a plurality, in this instance, four fins 36 formed in and connected to shell 14. A smaller or larger number of fins 36 could readily be used. Each fin 36 comprises a pair 37 of thin elongated curved plates 38 and 40 connected end to end to each other by a hinge 42 preferably disposed parallel to the longitudinal axis of shell 14. The opposite ends of plates 38 and 40 are connected to shell 14 by hinges 44 and 46, also preferably parallel to the longitudinal axis of shell 14.

It will be noted that the four plate pairs 37 parallel each other and are disposed diagonally around shell 14, and that each pair 37 is separately connected to both ends 16 and 18 of shell 14. When end 18 is rotated from the spring biased resting (storage) position of FIG. 1 to the deployed fin position of FIG. 2, as by impeller or rotor 47 or the like, electrically or otherwise powered, and housed in body 12, the plates 38 and 40 of each pair 37, which plates formerly lay in a low profile adjacent body 12, bulge; that is, extend outwardly from body 12 to form the four dome-shaped fins 36 which are equally spaced around the outer periphery of projectile 10 in order to flight stabilize it. All fins 36 simultaneously deploy to the same extent to effect a balanced and neutralized deployment. Each fin 36 has the thin plates 38 and 40 thereof parallel to the longitudinal axis of projectile 10 and defining a central fore-aft passageway 48 (FIG. 3) so as to minimize the air drag on projectile 10. Accordingly, a simplified, light weight fin-producing arrangement is provided for maximum efficiency. Fins 36 and shell 14 may be of any sheet metal or other suitable material but preferably are of spring steel. Projectile 10 has improved flight stability and storageability with fins 36 moving easily between their stored and deployed positions.

Figure 4:
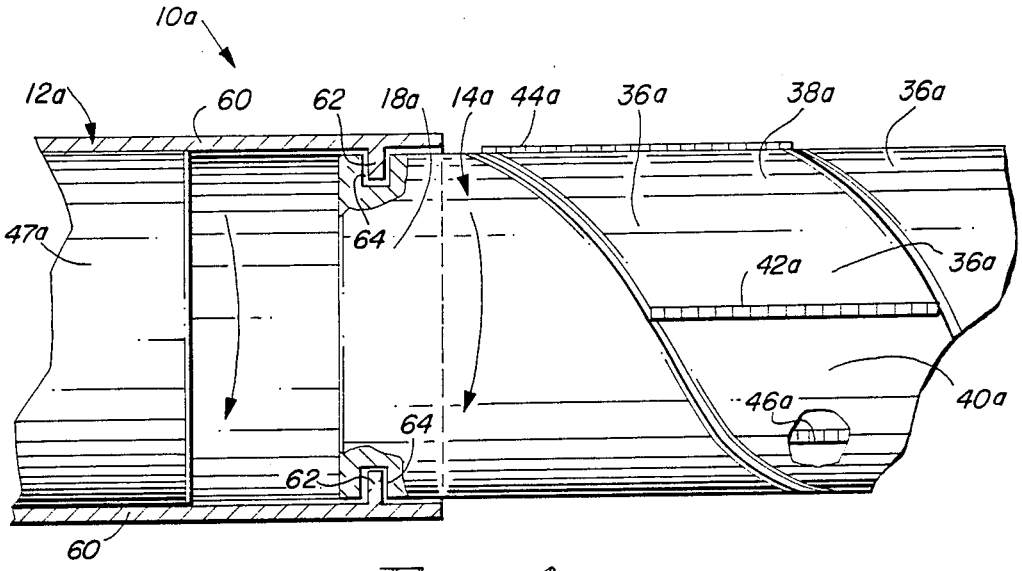
FIG. 4 is an enlarged fragmentary side elevation, partly broken away, of a second preferred embodiment of the improved projectile of the present invention, shown in the closed fin position; and, FIG. 5 is an enlarged schematic rear elevation of the projectile of FIG. 4 in a deployed fin position.
Figure 5:
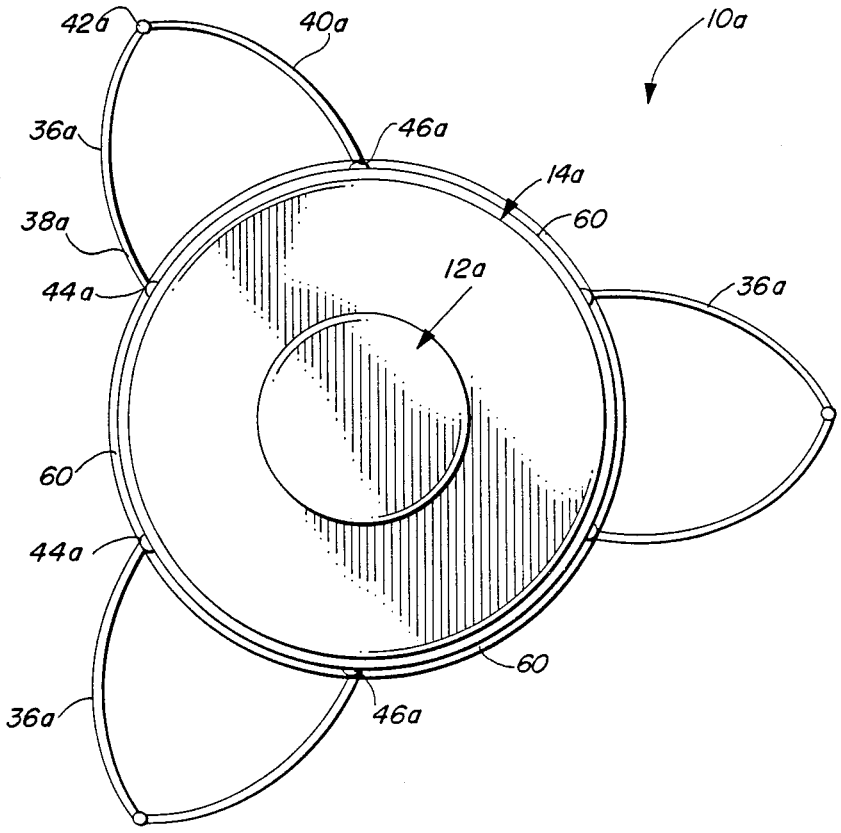

FIGS. 4 and 5

Now referring more particularly to FIGS. 4 and 5 of the drawings, a second preferred embodiment of the improved projectile of the present invention is schematically depicted therein. Thus, projectile **10*a* is shown. Components thereof similar to those of projectile 10 (FIGS. 1–3**) bear the same numerals but are succeeded by the letter "a".

Projectile **10*a* differs from projectile 10 in that three fins 36*a* are utilized in place of four fins 36. Moreover, end 18*a* of shell 14*a* is secured to a cowling 60 by keys 62 of cowling 60 in recesses 64 of end 18*a*. No spring such as spring 20 is present. Cowling 60 extends preferably from body 12*a* and is rotatably secured to a reversible rotor 47*a* in body 12*a* so as to rotate therewith between the closed fin position and FIG. 4 and the deployed fin position shown in FIG. 5. Rotor 47*a* can be powered electrically or otherwise, and acts to releasably lock end 18*a*** into the desired position.

Fins **36*a* are diagonaled across shell 14*a* and each fin comprises plates 38*a* and 40*a* connected by hinges 42*a*, 44*a* and 46*a* to each other and to shell 14*a*. Projectile 10*a* has the advantages and functions of projectile 10. It is flight stabilized with minimum air drag, collapsible, light weight, durable and efficient fins 36*a***. Further advantages of the invention are set forth in the foregoing.

Various modifications, alterations, changes and additions can be made in the improved projectile of the present invention, its components and parameters. All such modifications, changes, alterations and additions as are within the scope of the appended claims form part of the present invention.

What is claimed is:

1. An improved flight-stabilized projectile, said projectile comprising in combination:

(a) an elongated projectile body;

(b) an outer shell disposed around a portion of said body;

(c) a plurality of fins connected to and forming part of said shell for simultaneous movement of said fins between a closed low-profile position overlying the outer periphery of said body and a fully deployed flight-stabilizing position projecting outwardly from said body, each said fin comprising a pair of elongated plates separately hinged on the opposite ends thereof, one end of each said plate being hinged to the other of said pair of plates and the opposite ends of said pair of plates being hinged to said shell, said pairs of plates being aligned in a direction diagonal to the longitudinal axis of said body, with said hinges parallel to said longitudinal axis; and, (d) impeller means operatively connected to said shell for moving said fins between said stored and deployed positions.

2. The improved projectile of claim 1 wherein said body and shell are generally cylindrical and said plates are thin and curved, wherein said fins in said deployed position have a dome-shaped configuration in front elevation with each said fin defining a central rearwardly extending passageway therethrough, and wherein the main plane of said plates is parallel to said longitudinal axis for minimum air drag.

3. The improved projectile of claim 2 wherein all of said fins in said deployed position are disposed at about the same transverse line rearwardly of the front end of said shell.

4. The improved projectile of claim 2 wherein said projectile has either three or four of said fins equally spaced around the outer perimeter of said projectile.

5. The improved projectile of claim 2 wherein one end of said shell is fixedly secured to said body and the opposite end of said shell is rotatable around said longitudinal axis between fin deploying and fin closing positions.

6. The improved projectile of claim 5 wherein said rotatable end of said shell is secured to said impeller means.

7. The improved projectile of claim 6 wherein said impeller means includes a coil spring connected to said body and to said rotatable shell end, said spring biasing said shell into one of said two positions.

8. The improved projectile of claim 7 wherein said impeller means includes a releasable lock for releasably holding said rotatable shell in one of said two positions.

9. The improved projectile of claim 6 wherein said impeller means includes a cowling secured to a reversible rotor in said body and extending over and keyed to said rotatable shell end, whereby rotation of said cowling by said rotor correspondingly rotates said rotatable shell end, thereby moving said fins between said closed and deployed positions.

10. An improved projectile stabilizing assembly, comprising:

(a) a projectile body portion, (b) an elongated shell member having, (i) a fron portion, (ii) a rear portion, and (iii) a plurality of fin members disposed between and interconnecting said front and rear portions, (c) a storage mechanism for maintaining said fin members in an undeployed state, and (d) a deployment mechanism for moving said fin members to a deployed state, (e) wherein said front and rear portion are rotatable relative to one another.

11. The assembly of claim 10 wherein operation of said deployment mechanism causes relative rotation of said front and rear portion to effect simultaneous deployment of said fin members.

12. The assembly of claim 10 wherein said fin members are connected to said front and rear portions by base hinge means.

13. The assembly of claim 14 wherein said hinge means are parallel to one another.

14. The assembly of claim 10 wherein said fin members are hinged by fin hinge means at a point approximately midway along their length.

15. The assembly of claim 14 wherein the fin hinge means on each fin lie parallel to one another.

16. The assembly of claim 10 wherein said fin members are connected to said front and rear portion by base hinge means, and wherein said fin members are hinged by fin hinge means at a point approximately midway along their length, and wherein said base hinge means and fin hinge means are rotatable about axis which are all parallel to one another.

17. The assembly of claim 11 wherein said fin members are deployed substantially simultaneously.

18. The assembly of claim 11 wherein said shell member is substantially cylindrical.

* * * * *